US010015574B1

(12) United States Patent
Luce et al.

(10) Patent No.: US 10,015,574 B1
(45) Date of Patent: Jul. 3, 2018

(54) ACOUSTIC ASSEMBLY

(71) Applicant: Apple Inc., Cupertino, CA (US)

(72) Inventors: Thomas R. Luce, San Jose, CA (US); Robert I. Luan, Berkeley, CA (US); Thomas H. Tsang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/693,888

(22) Filed: Sep. 1, 2017

(51) Int. Cl.

| | |
|---|---|
| ***H04R 1/02*** | (2006.01) |
| ***H04R 1/04*** | (2006.01) |
| ***H04R 1/28*** | (2006.01) |
| ***H04R 7/18*** | (2006.01) |
| ***H04R 3/00*** | (2006.01) |

(52) U.S. Cl.
CPC ..... *H04R 1/025* (2013.01); *H04R 1/023* (2013.01); *H04R 1/04* (2013.01); *H04R 1/2853* (2013.01); *H04R 3/00* (2013.01); *H04R 7/18* (2013.01); *H04R 2499/11* (2013.01)

(58) Field of Classification Search
CPC ..... H04R 3/00; H04R 7/18; H04R 2499/11; H04R 1/025; H04R 1/023; H04R 1/04; H04R 1/2853
USPC ..... 381/333, 334
See application file for complete search history.

(56) References Cited

U.S. PATENT DOCUMENTS

| | | | | |
|---|---|---|---|---|
| 2009/0245565 | A1 | 10/2009 | Mittleman et al. | |
| 2011/0172001 | A1 | 7/2011 | Schoerkmaier | |
| 2015/0195631 | A1 | 7/2015 | Hawker et al. | |
| 2016/0073194 | A1 | 3/2016 | Auclair et al. | |
| 2016/0302000 | A1 | 10/2016 | Shin et al. | |
| 2017/0070795 | A1 | 3/2017 | Meyer | |
| 2017/0070813 | A1* | 3/2017 | Wah | H04R 1/34 |
| 2017/0149942 | A1* | 5/2017 | Lee | H04M 1/026 |
| 2017/0245032 | A1* | 8/2017 | Yoon | H04R 1/025 |

* cited by examiner

*Primary Examiner* — David Ton
(74) *Attorney, Agent, or Firm* — Kilpatrick, Townsend & Stockton LLP

(57) ABSTRACT

A portable electronic device is described and includes a device housing, an acoustic housing disposed within the device housing and defining an interior volume, a speaker diaphragm assembly disposed within the interior volume and in fluid communication with a first opening leading out of the housing, and a microphone disposed within the interior volume and in fluid communication with a second opening leading out of the acoustic housing. Placing both the speaker diaphragm assembly and microphone within the same acoustic housing allows both components to share common power and data transfer circuitry. Furthermore, the additional volume of the acoustic housing used to accommodate the microphone can improve the acoustic performance of the speaker diaphragm assembly by increasing the back volume associated with the speaker diaphragm assembly.

19 Claims, 9 Drawing Sheets

ACOUSTIC ASSEMBLY

FIELD

The described embodiments relate generally to the efficient integration of audio components within an electronic device. In particular, acoustic assembly that protects and incorporates both a microphone and speaker is described herein.

BACKGROUND

In an effort to progressively reduce the size of and concurrently improve the functionality of a portable electronic device, novel ways of optimizing space within the portable electronic device become increasingly important. Increased and improved functionality often come in the form of additional components and/or sensors. The additional components or sensors tend to take up space in a device housing of the portable electronic device that may not be available. While reducing a size of other components can help to produce additional space, such methods can unfortunately result in reduced functionality or performance. Consequently, additional methods for optimizing space within the device housing are desired.

SUMMARY

This disclosure describes various embodiments that relate to ways for securing both a speaker assembly and a microphone assembly within an acoustic housing.

An acoustic assembly is disclosed and includes: an acoustic housing defining an interior volume; a speaker diaphragm assembly disposed within the interior volume and dividing the interior volume into a front volume in fluid communication with an opening leading out of the acoustic housing and a back volume; and a microphone disposed within the back volume and in fluid communication with a channel leading out of the acoustic housing.

Another portable electronic device is disclosed and includes: a device housing; an acoustic housing disposed within the device housing and defining an interior volume; a diaphragm support structure disposed within the interior volume; a speaker diaphragm assembly disposed within the interior volume and in cooperation with the diaphragm support structure dividing the interior volume into a front volume acoustically coupled to an opening leading out of the acoustic housing and a back volume; and a microphone disposed within the back volume and acoustically coupled to a channel leading out of the acoustic housing.

Another portable electronic device is disclosed and includes: a device housing; an acoustic housing disposed within the device housing and defining an interior volume; a speaker diaphragm assembly disposed within the interior volume and in fluid communication with a first opening leading out of the housing; and a microphone disposed within the interior volume and in fluid communication with a second opening leading out of the acoustic housing.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
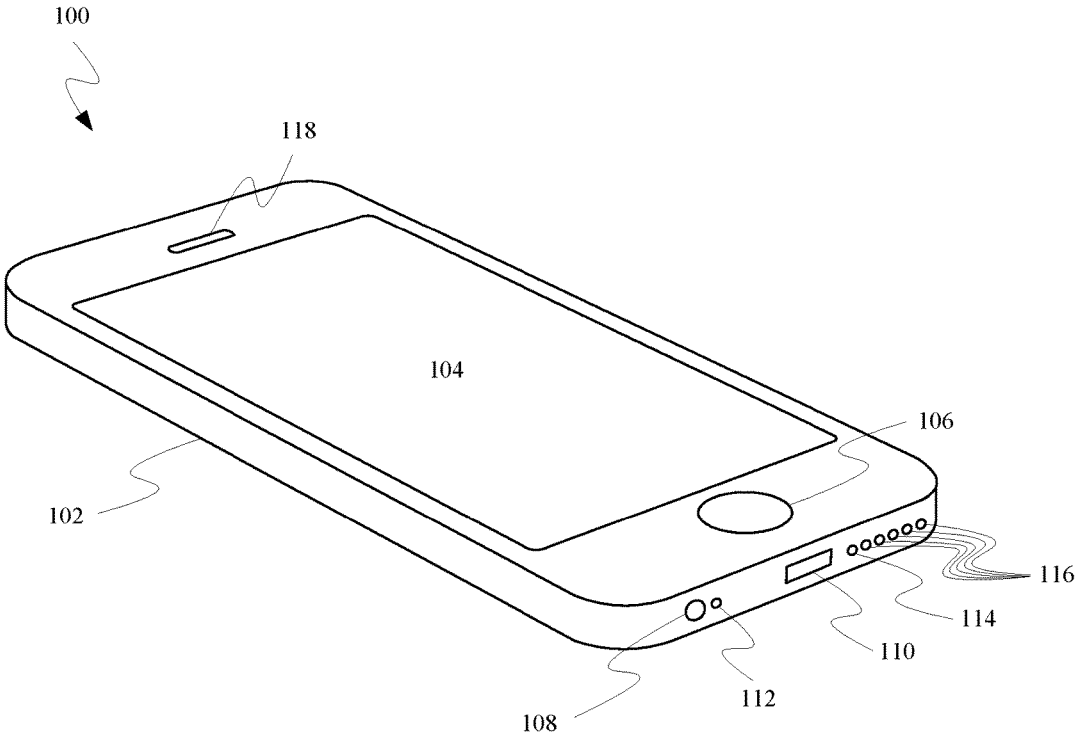
FIG. 1 shows a portable electronic device suitable for use with the embodiments disclosed herein.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Modern portable electronic devices are capable of carrying out a wide variety of functions. To accomplish these varied functions, many cutting edge components and sensors are packaged into a portable electronic device. While developing the portable electronic device with numerous discrete off the shelf components can result in a lower development cost, packaging these components into a device housing can be challenging and often result in many inefficiencies that cause the portable electronic device to be much larger than desired. One solution to this problem is to combine one or more components together so that the combined components can share common electrical and/or structural features, thereby saving space by reducing the number of redundant parts.

One function common to many portable electronic devices is the ability to provide a two-way link over which a conversation between at least two people can be conducted. At minimum, the portable electronic device includes both a speaker and a microphone so that each person can be both heard and listen during the conversation. Unfortunately, both the microphone and speaker often need to be positioned by an opening that allows audio to pass into and out of a device housing of the portable electronic device. Microphones and speakers also generally need to be oriented in a way that optimizes transmission of the audio. Orientation of these devices in this way can require various mounting hardware that can take up a substantial amount of space within the portable electronic device.

One way to reduce an amount of space taken up within the portable electronic device is to use a single piece of mounting hardware to secure multiple audio devices. For example, both a microphone and a speaker can be packaged within an acoustic housing before coupling the acoustic housing to an interior surface of a device housing of the portable electronic device. In some embodiments, an audio bracket can then be used to create a pathway between openings defined by the acoustic housing and openings associated with the device housing. Incorporating the speaker and microphone together in a single housing has many other benefits.

A first one of the benefits is that the acoustic housing can be enlarged without taking up more room than would otherwise be taken by a discrete speaker and microphone. This is beneficial since a larger interior volume for the speaker generally improves audio output. Even though the microphone does take up space within the acoustic enclosure, any open space surrounding the microphone can be used to increase a size of a back volume associated with the speaker. A second benefit of packaging the two components together is that when the acoustic housing is water resistant electrical components within the acoustic housing need less protection against the elements or undesirable contaminates. For example, electrical components that would otherwise need to be encapsulated could be left partially or fully exposed.

A third benefit is that the acoustic assembly can be independently tested prior to being shipped to a final manufacturing line. In embodiments where the acoustic assembly is water-sealed, pressurization testing, seal testing and other functional testing can be completed and verified, resulting in much smaller numbers of defective parts arriving at the final manufacturing line. Finally, by incorporating both acoustic assemblies together, the position of the microphone with respect to the speaker can be tightly controlled. This can allow for improved noise cancelling operations to be carried out due to the precise spatial position of the components.

These and other embodiments are discussed below with reference to FIGS. 1-5; however, those skilled in the art will readily appreciate that the detailed description given herein with respect to these figures is for explanatory purposes only and should not be construed as limiting.

FIG. 1 shows a portable electronic device 100 suitable for use with embodiments disclosed herein. Portable electronic device 100 can include a device housing 102 configured to protect various electrical components and sensors of portable electronic device 100. Portable electronic device 100 can also include touch sensitive display 104 configured to provide a touch sensitive user interface for controlling portable electronic device 100. A protective cover associated with touch sensitive display 104 can also cooperate with device housing 102 to substantially enclose operational and structural components of portable electronic device 100. In some embodiments, portable electronic device 100 can include additional controls such as, for example, button 106. Multiple hard-wired input/output (I/O) ports can include analog I/O port 108 and digital I/O port 110. Audio devices within device housing 102 can receive and transmit audio by way of audio openings. For example, audio opening 112 can be defined by device housing 102 and configured to allow audio to enter portable electronic device 100 and be detected by a microphone positioned within device housing 102. In some embodiments, audio opening 114 can also be associated with a microphone. A spatial interval between microphones associated with audio openings 112 and 114 can be used to perform a certain amount of beam forming that can filter unwanted audio out of the audio received by the two microphones. Device housing 102 also defines multiple audio openings 116, which can be associated with a speaker along the lines of a speaker phone suitable for allowing a user to monitor an audio conversation without having the user's ear positioned directly against portable electronic device 100 at speaker opening 118. In some embodiments, additional openings could be defined by housing 102 proximate audio opening 112. Portable electronic device 100 can include numerous other operational components, such as for example, a processor, one or more wireless transceivers, a non-transitory computer readable memory device and a battery. It should be noted that while the portable electronic device depicted has the shape of a cell phone device, the embodiments described herein could be used with other portable electronic devices such as tablets, laptop computers, media players and the like.

Figure 2A:
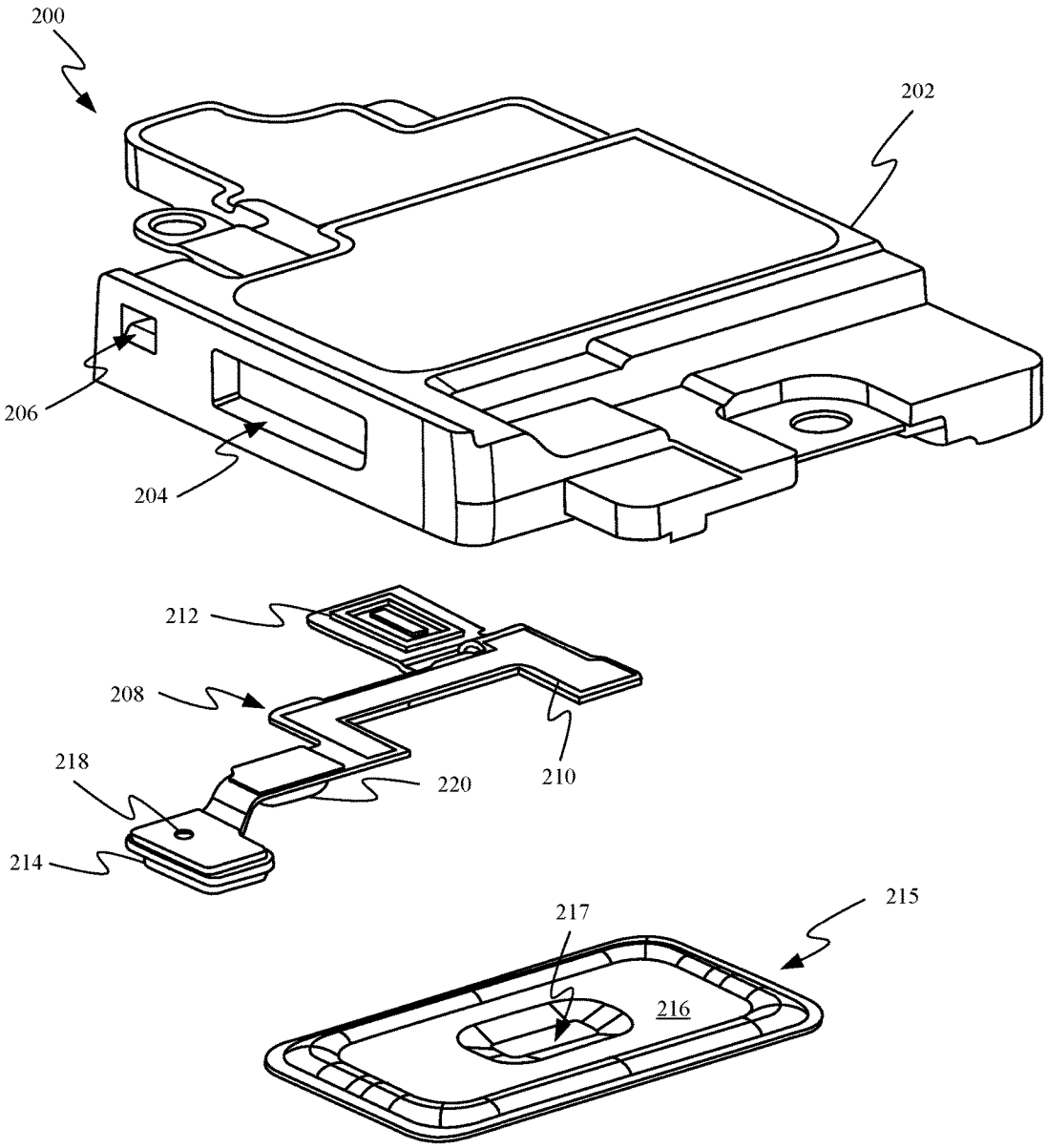
FIGS. 2A-2B cooperatively show an exploded perspective view of the primary components associated with an acoustic assembly suitable for use with the portable electronic device depicted in FIG. 1.
Figure 2B:
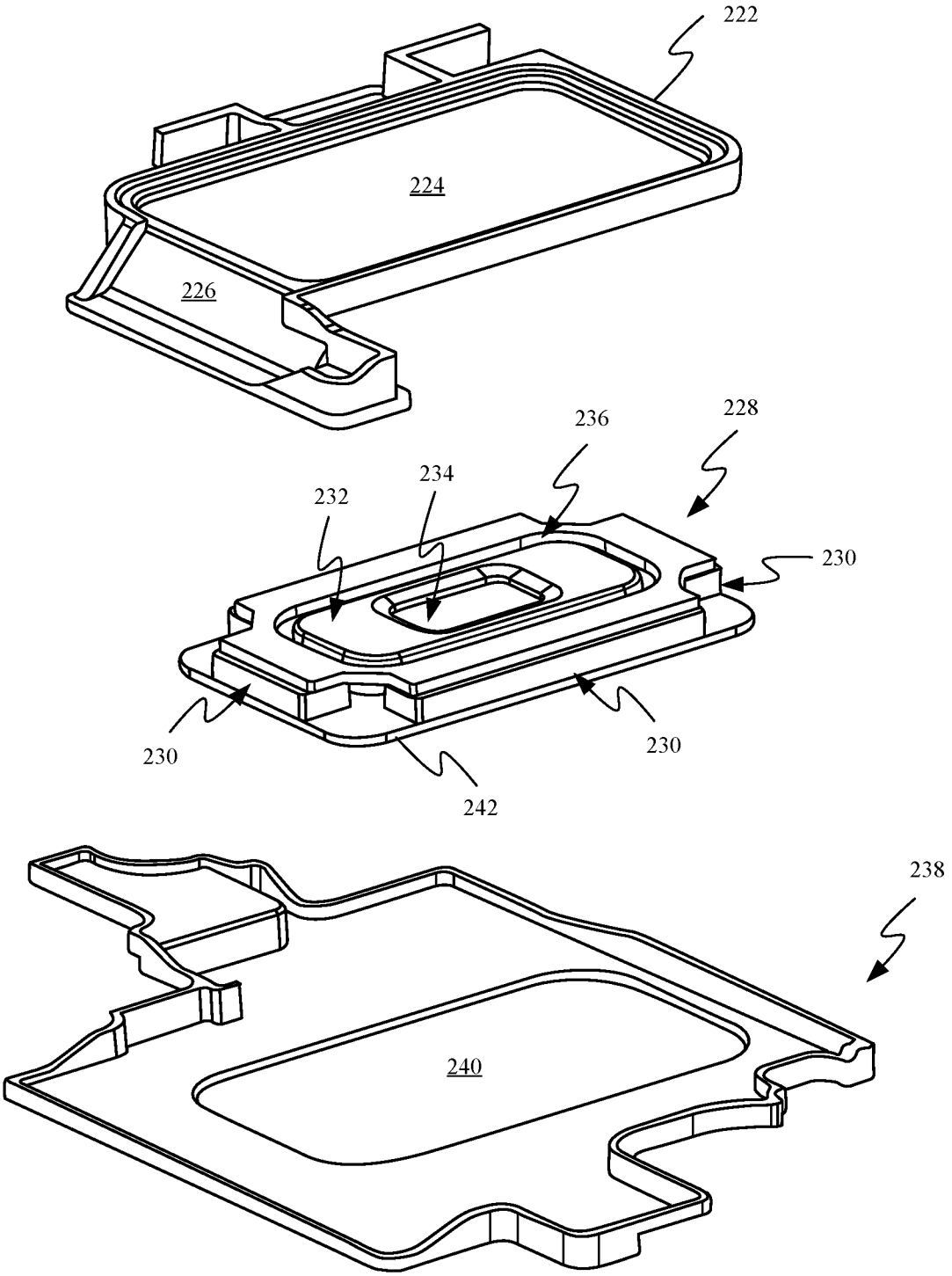

FIGS. 2A-2B cooperatively show an exploded perspective view of the primary components associated with an acoustic assembly 200. Acoustic assembly 200 can be secured within device housing 102 and configured to transmit and receive audio waves through openings 114 and 116 defined by device housing 102. Acoustic assembly 200 includes upper housing component 202. FIG. 2A depicts upper housing component 202, which defines speaker opening 204 and microphone channel 206 for transmitting and receiving audio waves, respectively. Upper housing component 202 can be shaped as depicted to accommodate other electrical components in close proximity to acoustic assembly 200.

FIG. 2A also depicts flexible circuit 208 below upper housing component 202. Flexible circuit 208 can take the form of a multi-layer polymeric substrate with embedded electrically conductive traces for sending and receiving power and data. In some embodiments, flexible circuit can include a polyimide substrate with one or more layers of printed copper pathways routed along one or more layers of flexible circuit 208. Flexible circuit 208 can be secured to an interior facing surface of upper housing component 202. Flexible circuit 208 can be secured to upper housing component 202 in many ways, including by a layer of pressure sensitive adhesive 210. Alternatively, flexible circuit 208 can be glued directly to upper housing component 202. Flexible circuit 208 can include an electrical connector, which can function to receive and/or transmit power and data between other components disposed within device housing 102 and acoustic assembly 200. In some embodiments, the electrical connector can take the form of board to board connector 212. Flexible circuit 208 can be electrically coupled to both microphone 214 and speaker diaphragm assembly 215. Speaker diaphragm assembly 215 can include a diaphragm 216 with a central recess 217 that helps establish a desired rigidity of diaphragm 216. In this way, flexible circuit 208 allows audio waves received through microphone channel 206 and picked up by microphone 214 to be transmitted to another component, such as a processor, for further processing. Flexible circuit 208 includes opening 218 through which audio waves can pass through the polymeric substrate of flexible circuit 208 to reach microphone 214. Similarly, media content can be received by speaker diaphragm assembly 215 for generation and transmission of audio waves out of device housing 102. Signals associated with media content can arrive at an electrically conductive coil (not depicted) of speaker diaphragm assembly 215 for generation of audio waves. Flexible circuit 208 can include surface mounted passive components 220, which are surface mounted to the flexible substrate of flexible circuit 208 and can be configured to conduct processing and/or boost signals passing through flexible circuit 208. In some embodiments, passive components 220 can help filter and perform preprocessing on audio signals generated by microphone 214.

FIG. 2B depicts diaphragm support structure 222. Diaphragm support structure 222 is configured to provide support for speaker diaphragm assembly 215. Specifically, diaphragm support structure defines an opening 224 that accommodates oscillation of diaphragm 216. By supporting only a peripheral region of diaphragm 216, interference from diaphragm support structure can be avoided. Diaphragm support structure 222 also establishes a desired standoff distance between an interior-facing surface of upper housing component 202 and speaker diaphragm assembly 215. Diaphragm support structure 222 can also include audio conduit 226 that in cooperation with upper housing component 202 provide a pathway for audio generated by speaker diaphragm assembly 215 to exit acoustic assembly 200.

FIG. 2B also depicts magnetic driver assembly 228. Magnetic driver assembly 228 can be made up of multiple permanent magnets configured to interact with the electrically conductive coil of speaker diaphragm assembly 215 to induce oscillation of diaphragm 216 and thereby generate audio output. In particular, magnetic driver assembly 228 includes peripheral permanent magnets 230 and central permanent magnet 232. In some embodiments, central permanent magnet 232 can include a recess 234 for accommodating central recess 217 of diaphragm 216. Furthermore, peripheral permanent magnets 230 can cooperate with central permanent magnet 232 to create a channel 236 sized to accommodate an electrically conductive coil of speaker diaphragm assembly 215. Permanent magnets 230 and 232 cooperatively generate a magnetic field within channel 236 for magnetic interaction with the electrically conductive coil of speaker diaphragm assembly 215. Openings between permanent magnets 230 allow air to move freely between channel 236 and the surrounding space within acoustic assembly 200, helping to establish a less constrained back volume for speaker diaphragm assembly 215.

FIG. 2B also depicts a lower housing component 238. Lower housing component 238 defines an opening 240 within which substrate 242 of magnetic driver assembly 228 is secured. Together with upper housing component 238, a back volume of air is enclosed beneath diaphragm 216. This allows a majority of the interior volume defined by acoustic assembly 200 to be used to improve audio output generated by speaker diaphragm assembly 215.

Figure 3A:
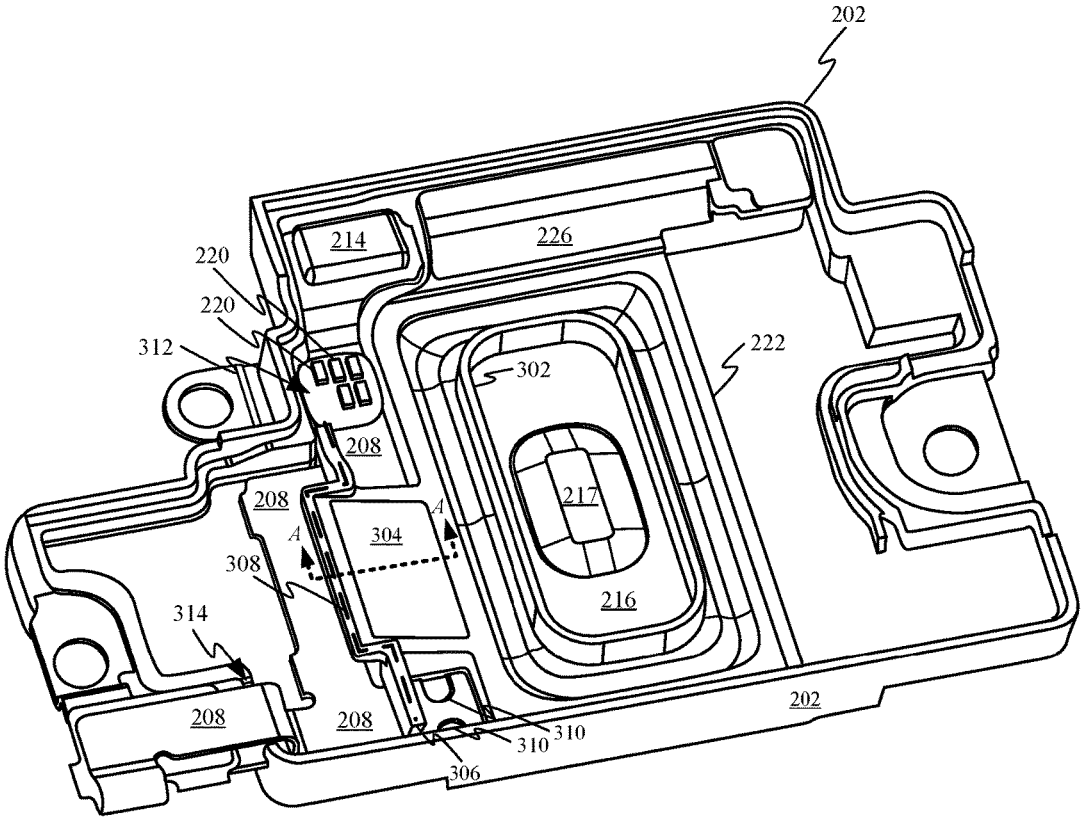
FIG. 3A shows an upper housing component with components depicted in FIG. 2A-2B arranged therein.

FIG. 3A shows upper housing component 202 with components depicted in FIG. 2 arranged therein. FIG. 3A shows in particular how speaker diaphragm assembly 215 includes electrically conductive coil 302 coupled to one side of diaphragm 216. FIG. 3A also shows a periphery of diaphragm 216 positioned between diaphragm support structure 222 and upper housing component 202. In addition to supporting diaphragm 216, diaphragm support structure 222 also includes a mesh barrier 304, which can be configured to retain acoustic beads within a first region of acoustic assembly 200. Flexible circuit 208 is depicted being routed along an interior-facing surface of upper housing component 202. Because acoustic assembly can be fully assembled as a discrete component prior to it being incorporated into a device such as portable electronic device 100, flexible circuit 208 can be glued to upper housing component 202 and allowed to cure, yielding a substantially more secure coupling that would otherwise be achievable by a pressure sensitive adhesive layer. In this position, flexible circuit 208 can be routed beneath arms 306 of diaphragm support structure 222 that protrude laterally from opposing sides of mesh barrier 304. Arms 306 help form a barrier, see dashed line 308, which indicates how arms 306 divide an interior volume of acoustic assembly 200 into first and second interior regions. Flexible circuit 208 also includes contacts 310 that are configured to electrically couple speaker diaphragm assembly 215 with microphone 214 and board to board connector 212. Contacts 310 primarily feed power and signals to electrically conductive coil 302 causing electrically conductive coil 302 to generate a magnetic field that interacts with permanent magnets 230 and 232 to induce motion of diaphragm 216 for the generation of audio waves.

FIG. 3A also shows surface mounted passive components 220, which are surface mounted to flexible circuit 208. Passive components 220 are depicted only partially encapsulated by encapsulate 312. The partial encapsulation is possible in configurations where the interior of acoustic assembly 200 is sealed from the ingress of external contaminates. This reduces the likelihood of surface mounted passive components 220 being damaged by contact with external contaminates. Surface mounted passive components 220 can take the form of resistors, capacitors and other passive electrical components. FIG. 3A also illustrates how audio conduit 226 extends to a sidewall of upper housing component 202 to create a sealed front volume in communication with an exterior of acoustic assembly 200 through speaker opening 204 (see FIG. 2). It should be noted that upper housing component 202 defines a notch 314 sized to accommodate the passage of flexible circuit 208. The notch can have a depth equivalent to a thickness of flexible circuit 208, thereby preventing circuit traces within flexible circuit 208 from being compressed or otherwise damages when lower housing component 238 is coupled to upper housing component 202. Alternatively, lower housing could define notch 314 or both lower and upper housing components 238 and 202 respectively could define the notch to accommodate flexible circuit 208 exiting an interior volume defined by upper and lower housing components of acoustic assembly 200. After routing flexible circuit 208 through notch 314, any area surrounding the flexible circuit can be filled to keep acoustic assembly 200 sealed.

Figure 3B:
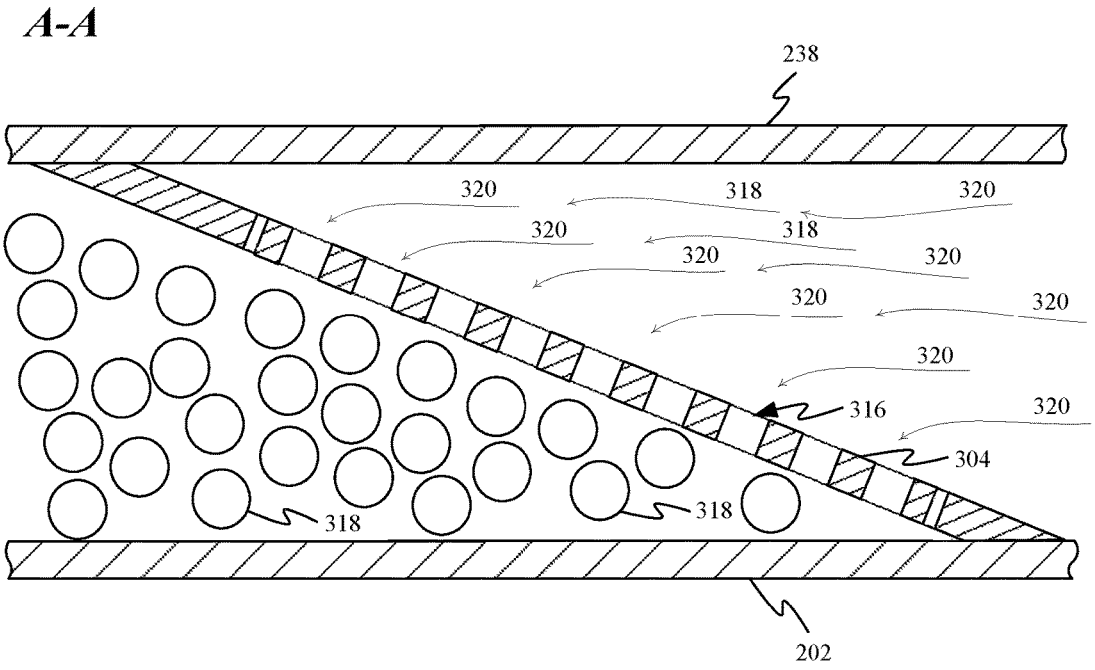
FIG. 3B shows a cross-sectional view of a portion of an acoustic assembly in accordance with section line A-A as shown in FIG. 3A.

FIG. 3B shows a cross-sectional view of a portion of acoustic assembly 200 in accordance with section line A-A. In particular, FIG. 3B shows how mesh barrier 304 has openings 316 small enough to prevent any of acoustic beads 318 from passing through mesh barrier. In this way, acoustic beads 318 can be prevented from contaminating the portion of acoustic assembly 200 containing speaker diaphragm assembly 215 and microphone 214. Furthermore, openings 316 can be sized to accommodate the passage of audio waves 320 through mesh barrier 304. This allows the area behind mesh barrier 304 to further augment the performance of speaker diaphragm assembly 215 by expanding its back volume. Acoustic beads 318 can help improve the acoustic characteristics of one portion of the interior volume defined by acoustic assembly 200. For example, acoustic beads 318 can reduce the likelihood of unwanted vibration and/or resonant motion that would degrade audio input or output associated with acoustic assembly 200.

Figure 3C:
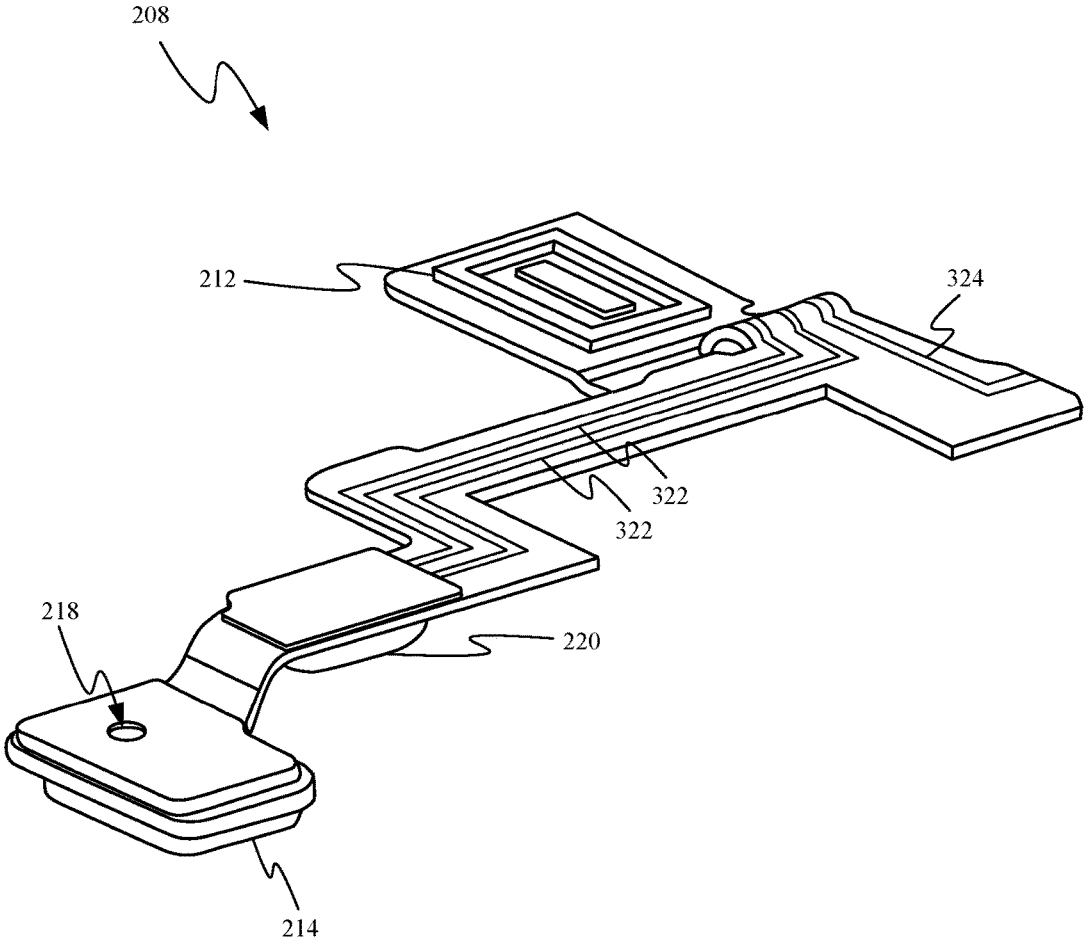
FIG. 3C shows a perspective view of a flexible circuit and indicates how signals are routed within the flexible circuit.

FIG. 3C shows a perspective view of flexible circuit 208 and how electrically conductive traces can be routed within flexible circuit 208. Electrically conductive traces 322 can be arranged along flexible circuit 208 and carry signals to and from microphone 214 to board to board connector 212. Similarly electrically conductive trace 324 can carry signals to contacts 310 (see FIG. 3A), for delivery of power and signals to electrically conductive coil 302 of speaker diaphragm assembly 215. As depicted, electrically conductive traces 322 and 324 can be laterally separated from each other instead of being separated by only a thin film layer on a different layer of flexible circuit 208. In some embodiments, electrically conductive traces 312 can also be on a different layer of flexible circuit 208 from electrically conductive trace 314. In this way, any cross-talk between signals travelling to speaker diaphragm assembly 215 and signals travelling to microphone 214 can be substantially reduced. Flexible circuit 208 can be made substantially wider to accommodate the lateral separation of conductive traces than it might otherwise be outside of acoustic assembly 200 due to assembly complexity that would otherwise occur with a flexible circuit that needed to be threaded between other components during the device assembly phase of manufacturing.

Figure 4A:
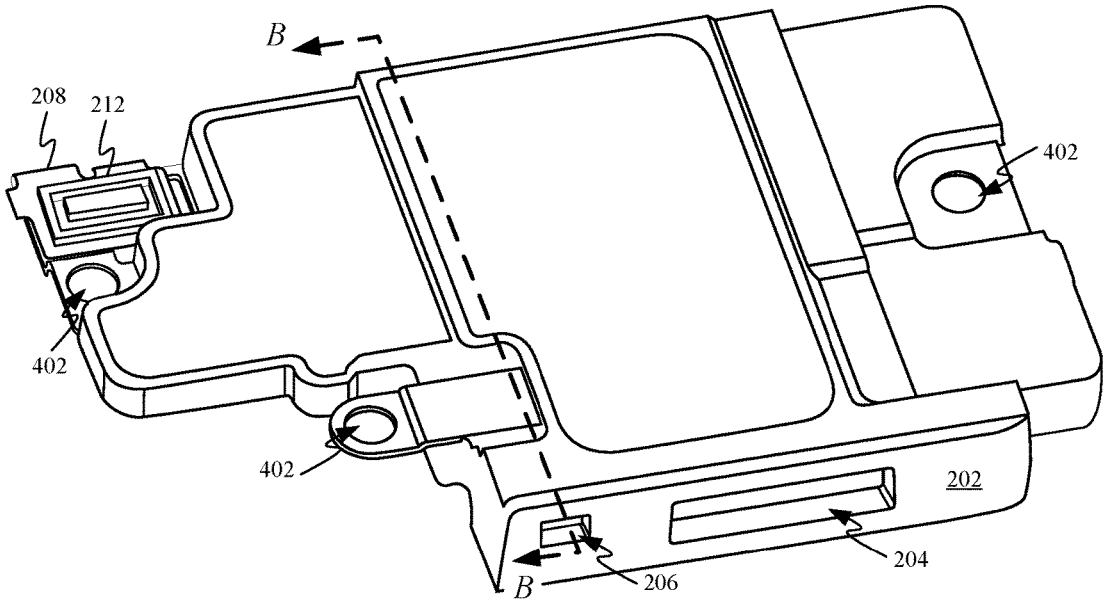
FIG. 4A shows another perspective view of the acoustic assembly depicted in FIG. 2.

FIG. 4A shows another perspective view of acoustic assembly 200. Mounting openings 402 are depicted, which provide locations for fasteners to secure acoustic assembly 200 to an interior surface of an electronic device along the lines of portable electronic device 100. By folding flexible circuit 208 around a back side of acoustic assembly 200, board to board connector 212 can remain accessible for connection after acoustic assembly 200 has been secured in place to an electronic device housing. Board to board connector 212 can then allow acoustic assembly 200 to be conveniently incorporated with other electronics of portable electronic device 100.

Figure 4B:
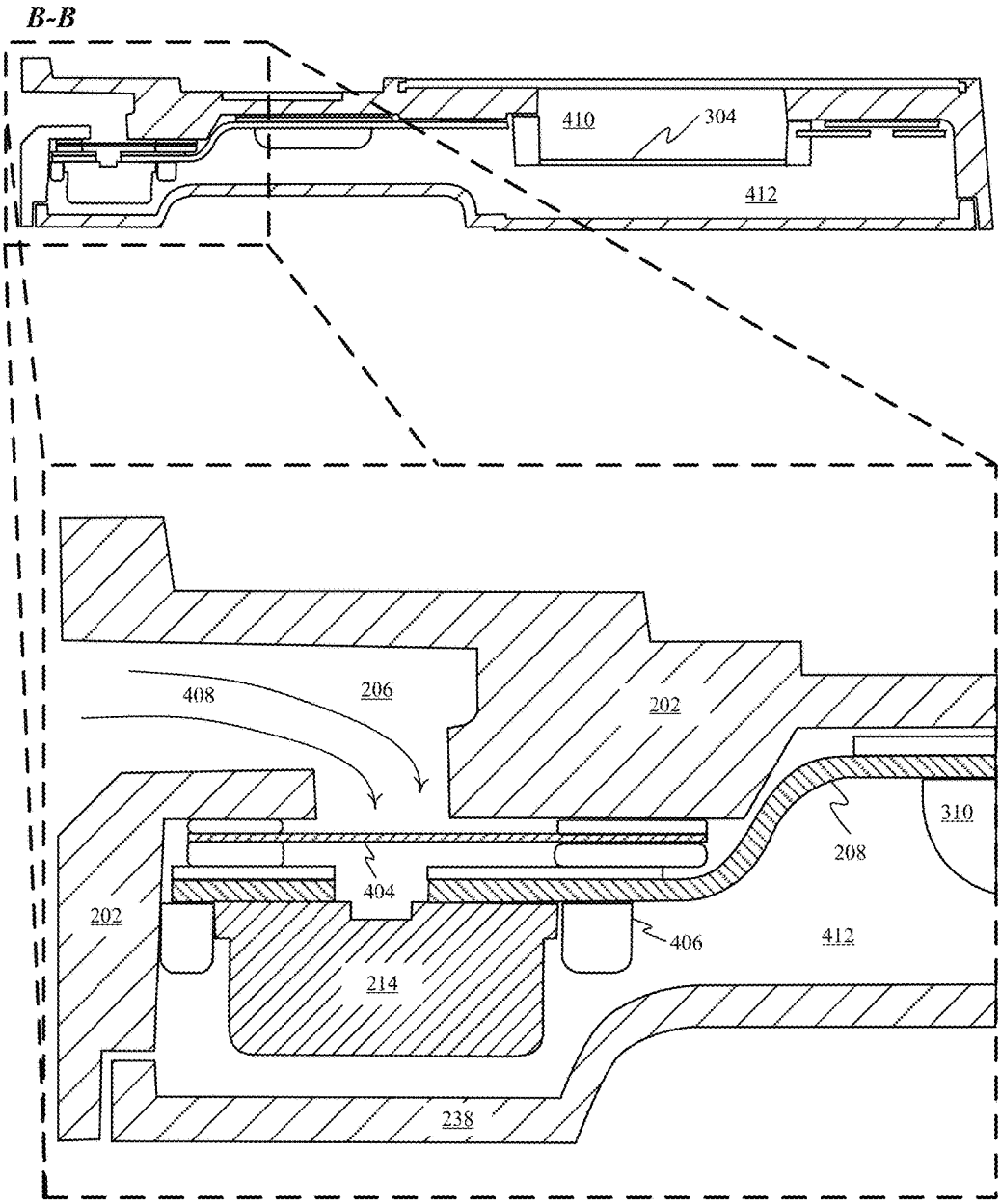
FIG. 4B shows a cross-sectional view of the acoustic assembly depicted in FIG. 4A in accordance with section line B-B.

FIG. 4B shows a cross-sectional view of acoustic assembly 200 in accordance with section line B-B as depicted in FIG. 4A. FIG. 4B includes a close up view that shows a mounting attachment for microphone 214. The mounting attachment is designed to prevent motion of diaphragm 216 from degrading sensor output. This is particularly important since a membrane of microphone 214 is configured to oscillate in the same direction as diaphragm 216. The mounting attachment can include a stack of components such as mesh screen 404 to prevent entry of foreign particles from entering microphone 214 and foam layer 406 undesired motion of microphone 214. It should also be noted that the geometry of microphone channel 206 prevents any incoming particles from directly impacting mesh screen 404, thereby reducing wear and tear on mesh screen 404. Microphone channel is shaped particularly to prevent the 90 degree turn taken by audio waves 408 entering channel from suffering from undue attenuation or distortion. FIG. 4B is also helpful in distinguishing front volume 410 from back volume 412 within acoustic assembly 200.

Figure 5:
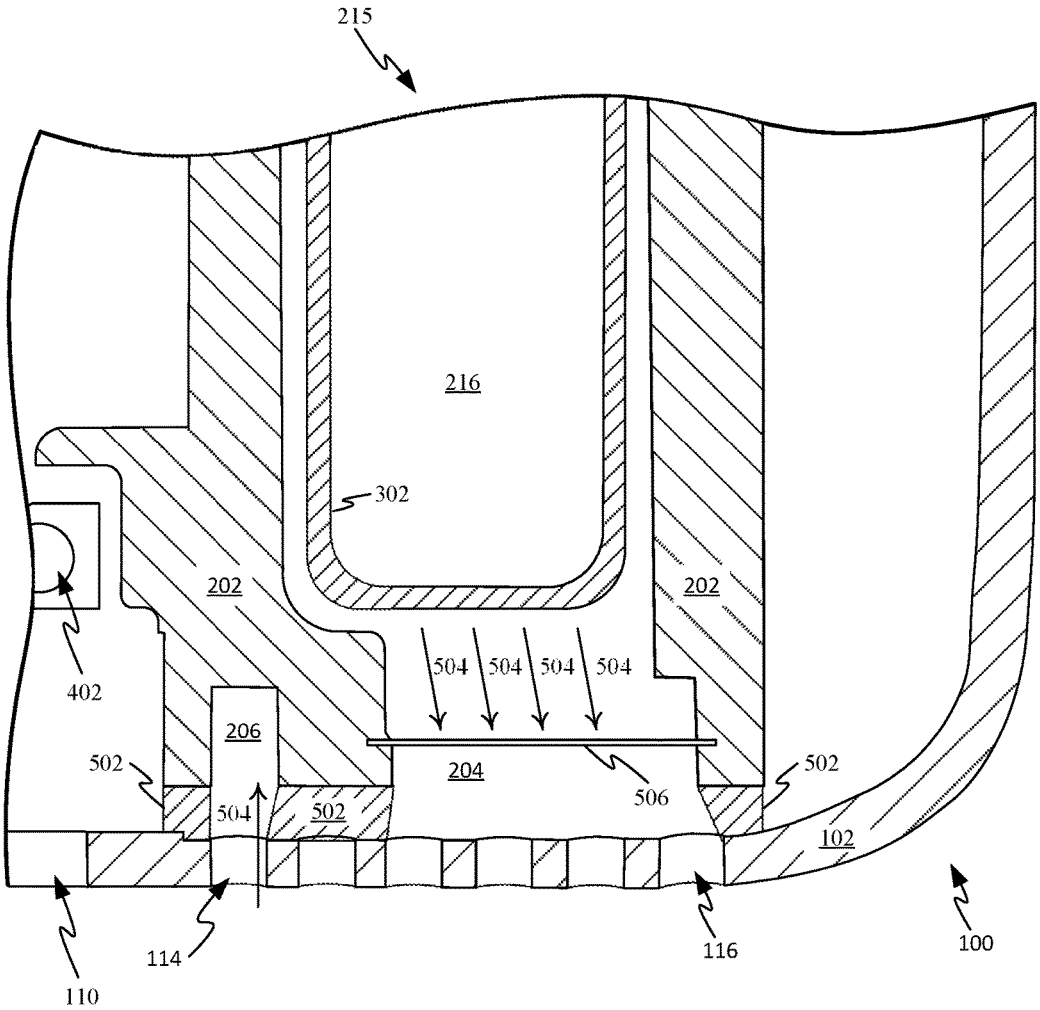
FIG. 5 shows a top view of an acoustic assembly disposed within a device housing.

FIG. 5 shows a top view of acoustic assembly 200 disposed within device housing 102. In particular, FIG. 5 shows how speaker opening 2004 can be linked to audio openings 116 by bracket 502. Bracket 502 defines channels configured to port audio waves 504 into and/or out of acoustic assembly 200. In some embodiments, bracket 502 can be coupled to both a wall of device housing 102 and a surface of upper housing component 202 that defines speaker opening 204 and microphone channel 206. Bracket 502 can be coupled in many different ways, including by fasteners and/or adhesive strips. The coupling means can also include seals designed to prevent any water passing through bracket 502 from escaping through an interface between bracket 502 and either of device housing 102 or upper housing component 202. Acoustic assembly 200 can also be coupled to device housing 102 by a fastener extending through one of openings 402. In this way, acoustic assembly 200 can be fixed firmly in place within portable electronic device 100.

FIG. 5 also shows mesh barrier 506, which functions to keep contaminates from entering and doing damage to speaker diaphragm assembly 215. In some embodiments, mesh barrier 506 can include a membrane that prevents water intrusion. In other embodiments, mesh barrier 506 can allow the passage of water into a front volume associated with speaker diaphragm assembly 215. The front volume is sealed from other areas within acoustic assembly 200 by an upward facing surface of diaphragm 216 so that any water entering into the front volume only contacts the one side of diaphragm 216 and is unable to adversely affect other components within acoustic assembly 200.

The various aspects, embodiments, implementations or features of the described embodiments can be used separately or in any combination. Various aspects of the described embodiments can be implemented by software, hardware or a combination of hardware and software.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A portable electronic device, comprising:

a device housing enclosing an interior volume;

an acoustic housing coupled to the device housing, the acoustic housing being disposed within the interior volume and enclosing a portion of the interior volume;

a speaker diaphragm assembly disposed within the acoustic housing and dividing the portion of the interior volume into a first volume and a second volume, the acoustic housing defining a first opening leading out of the first volume; and a microphone disposed within the second volume and configured to receive audio waves through a second opening leading into the acoustic housing.

2. The portable electronic device as recited in claim 1, wherein the speaker diaphragm assembly and the microphone are configured to oscillate in the same direction.

3. The portable electronic device as recited in claim 1, wherein the acoustic housing comprises a plurality of integrally formed walls that enclose the microphone and speaker diaphragm assembly.

4. The portable electronic device as recited in claim 1, wherein the second opening has a geometry that includes a 90 degree turn.

5. The portable electronic device as recited in claim 1, further comprising:

a diaphragm support structure supporting a peripheral region of the speaker diaphragm assembly within the device housing.

6. The portable electronic device as recited in claim 5, wherein the diaphragm support structure further comprises a mesh window that divides the second volume.

7. The portable electronic device as recited in claim 1, further comprising an electrical connector positioned along an outside surface of the acoustic housing and configured to receive electrical power for operation of the microphone and speaker.

8. A portable electronic device, comprising:

a device housing enclosing an interior volume;

an acoustic housing coupled to the device housing, the acoustic housing being disposed within the interior volume and enclosing a portion of the interior volume;

a diaphragm support structure disposed within the portion of the interior volume;

a speaker diaphragm assembly disposed within the volume and in cooperation with the diaphragm support structure dividing the portion of the interior volume into a first volume and a second volume acoustically coupled to an opening leading out of the acoustic housing; and a microphone disposed within the first volume and configured to receive audio waves through a channel leading into the acoustic housing.

9. The portable electronic device as recited in claim 8, wherein the acoustic housing comprises top, bottom and side walls that enclose the speaker diaphragm assembly and the microphone.

10. The portable electronic device as recited in claim 8, further comprising:

a flexible circuit electrically coupling both the microphone and the speaker diaphragm assembly to an electrical connector outside of the acoustic housing.

11. The portable electronic device as recited in claim 10, wherein a portion of the flexible circuit carries signals associated with both the speaker diaphragm assembly and the microphone and wherein the portion of the flexible circuit that carries the signals from both components includes electrically conductive traces that carry signals associated with the speaker diaphragm assembly on a first side of the flexible circuit laterally offset from electrically conductive traces that carry signals associated with the microphone on a second side of the flexible circuit.

12. The portable electronic device as recited in claim 8, wherein the diaphragm support structure defines a channel extending from the speaker diaphragm assembly to the opening leading out of the acoustic housing.

13. The portable electronic device as recited in claim 8, wherein the acoustic housing is coupled to an interior-facing surface of the device housing.

14. The portable electronic device as recited in claim 8, further comprising:

a bracket defining one or more acoustic channels extending between an exterior surface of the acoustic housing and openings defined by a wall of the device housing.

15. The portable electronic device as recited in claim 14, wherein the bracket couples one end of the acoustic housing to the wall of the device housing.

16. A portable electronic device, comprising:

a device housing;

an acoustic housing secured to one or more walls of the device housing, the acoustic housing being disposed within the device housing and defining an interior volume;

a speaker diaphragm assembly disposed within the interior volume and dividing the interior volume into a first volume and a second volume, the speaker diaphragm assembly being configured to generate audio waves that exit the acoustic housing through a first opening leading out of the first volume; and a microphone disposed within the second volume and configured to receive audio waves through a second opening defined by the acoustic housing.

17. The portable electronic device as recited in claim 16, further comprising a diaphragm support structure that in cooperation with the speaker diaphragm assembly divides the interior volume into the first volume and the second volume.

18. The portable electronic device as recited in claim 16, further comprising a flexible circuit disposed at least partially within the second volume and electrically coupling both the speaker diaphragm assembly and microphone to an electrical connector external to the acoustic housing.

19. The portable electronic device as recited in claim 16, wherein the acoustic housing comprises top, bottom and side walls that enclose the speaker diaphragm assembly and the microphone.

* * * * *